US006979260B2

(12) United States Patent
Liu

(10) Patent No.: US 6,979,260 B2
(45) Date of Patent: Dec. 27, 2005

(54) METHOD AND DEVICE TO PREVENT INDOOR RELEASE OF CARBON MONOXIDE AND SMOKE FROM COMBUSTORS

(75) Inventor: Henry Liu, Columbia, MO (US)

(73) Assignee: Freight Pipeline Company, Columbia, MO (US)

( * ) Notice: Subject to any disclaimer, the term of this patent is extended or adjusted under 35 U.S.C. 154(b) by 0 days.

(21) Appl. No.: 10/731,206

(22) Filed: Dec. 10, 2003

(65) Prior Publication Data

US 2005/0130576 A1 Jun. 16, 2005

(51) Int. Cl.[7] ..... F24F 11/00
(52) U.S. Cl. ..... 454/255; 454/251; 454/256
(58) Field of Search ..... 454/238, 239, 454/251, 255, 256, 257, 275, 333

(56) References Cited

U.S. PATENT DOCUMENTS

| | | | | |
|---|---|---|---|---|
| 4,171,773 | A * | 10/1979 | Preston | 237/55 |
| 5,131,887 | A * | 7/1992 | Traudt | 454/255 |
| 5,394,934 | A * | 3/1995 | Rein et al. | 165/200 |
| 6,283,851 | B1 * | 9/2001 | Smith et al. | 454/256 |
| 6,328,647 | B1 * | 12/2001 | Traudt | 454/255 |
| 6,742,516 | B2 * | 6/2004 | McCarren | 126/504 |

* cited by examiner

*Primary Examiner*—Harold Joyce
(74) *Attorney, Agent, or Firm*—Senniger Powers

(57) ABSTRACT

A device to prevent indoor release of carbon monoxide and smoke from indoor combustors (stoves, furnaces, fireplaces, etc.). The device is based on a discovery that safe operation of indoor burners requires the air pressure in the room housing the burner to be relatively high in order to prevent generation of reverse chimney flow and indoor release of exhaust gas (smoke and carbon monoxide), which are dangerous to building occupants. This device solves the problem by increasing the building internal pressure.

9 Claims, 4 Drawing Sheets

METHOD AND DEVICE TO PREVENT INDOOR RELEASE OF CARBON MONOXIDE AND SMOKE FROM COMBUSTORS

CROSS-REFERENCE TO RELATED APPLICATIONS

Not applicable (There is no related application)

STATEMENT REGARDING FEDERALLY SPONSORED RESEARCH OR DEVELOPMENT

Not applicable (Invention is not a result of any sponsored research)

REFERNCE TO SEQUENCE LISTING, A TABLE, OR A COMPUTER PROGRAM LISTING COMPACT DISK

Not applicable (None)

REFERENCES

The references used in the discussion of this SPECIFICATION are listed as follows:

1. Liu, H., *Wind Engineering: A Handbook for Structural Engineers*, Prentice Hall Publisher, Englewood Cliffs, N.J., 1991, pp. 84–89.
2. Liu, H. and Saathoff, P. J., "Internal Pressure and Building Safety," *Journal of Structural Division*, American Society of Civil Engineers, Vol. 108, No. 10, 1982, pp. 2223–2234.
3. Sabersky, R. H., Acosta, A. J., Hauptmann, E. G., and Gates, E. M., *Fluid Flow: A First Course in Fluid Mechanics*, 4$^{th}$ Edition, Prentice Hall Publisher, Upper Saddle River, N.J., 1999. (In problem 3.7 stated on pages 99–100, with answer given on page 588.)
4. Liu, H., "Analysis of Wind Effect on the Performance of Indoor Burners," confidential paper prepared for patent application, Jun. 1, 2003, 4 pages.
5. U.S. Pat. No. 5,276,434, entitled "Carbon Monoxide Concentration Indicator and Alarm," by Brooks et al., 1994.
6. U.S. Pat. No. 5,947,814, entitled "Garage CO Venting System," by Czeck et al., 1999.
7. U.S. Pat. No. 6,503,141, entitled "Carbon Monoxide Venting System," by Meneely, Jr., 2003.

BACKGROUND OF THE INVENTION

1. Brief History of the Invention

During a cold evening in January 2003, the applicant discovered that the fireplace in his home was malfunctioning, emitting smoke into the room rather than expelling the smoke through the chimney. This has brought some concern to the applicant, and raised his curiosity as to the cause. Since that evening was unusually windy, wind was suspected as being the cause or the culprit. In the days and months following that incident, the applicant being a wind engineer who has taught wind engineering at University of Missouri-Columbia, and has written a book on the subject (see Reference 1), has been thinking about the incident, and trying to explain the phenomenon observed by using principles of fluid mechanics and wind engineering. Consequently, he has come to the realization that the reverse chimney flow that brought smoke into the room must have been induced by a low building internal pressure caused by wind. He also spent days in thinking to find a practical means to prevent such reverse chimney flow from occurring, and came up with the subject invention.

2. Operational Principles

This invention is based on the principles of building internal pressure, chimney effect, and stagnation tube, which are subjects of wind engineering, industrial aerodynamics, and fluid mechanics, respectively. Through a proper integration and utilization of these principles, which have not been done before in any prior art or practice, this invention was produced. In what follows, the three underlying principles are first reviewed briefly, and then their proper combination and utilization pertaining to the subject invention are described.

A. Building Internal Pressure

From wind engineering such as described in Reference 1, it is known that when wind blows over a building, it generates both an external pressure on the building exterior surface and an internal pressure inside the building. The external pressures on the windward wall and on the windward part of a steep roof are positive (i.e., above atmospheric or above ambient), whereas the external pressures on the side walls, leeward wall, and the roof (including flat roofs, roofs of mild slope, and the leeward part of any roof) are negative (i.e., below atmospheric or ambient). If the building has openings distributed approximately uniformly over various walls and the roof as it is usually the case, the internal pressure will be negative as explained in References 1 and 2. It is for this reason that the building internal pressure is usually negative during windy days, and the magnitude of this negative pressure (i.e., suction) increases as the square of the wind speed. This negative pressure inside buildings is detrimental to the proper operation of any type of indoor burners, which relies on the chimney to expel the combustion exhaust gases, including smoke, carbon dioxide and carbon monoxide, to the outdoor environment. The situation is especially dangerous when the combustion rate is reduced near the end of burning the last pile of wood in a fireplace at night when people were asleep. Due to the negative internal pressure or suction generated in the house or building by wind, the combustion exhaust including carbon monoxide and smoke can be sucked into the room rather than expelled outdoors through the chimney or flue. This can cause tragedy in winter time when one fails to extinguish the fire in a burner or fireplace before going to bed. Such tragedies can be prevented by controlling the internal pressure of the room in which the burner is used—making the internal pressure always positive.

This invention presents two effective and practical means to maintain a positive internal pressure needed for safe indoor combustion. The first means is to use an air pump, be it a fan, a blower or a compressor, to pump outdoor fresh air into the house, which will result in a rise of the building internal pressure. The second method is to use a specially designed stagnation tube, also called "simple pitot tube," that is always facing the wind in order to generate a stagnation pressure at the tube inlet. The stagnation pressure in turn drives the outdoor fresh air into the pitot tube and through the connecting tubing into the room in which the burner is located.

B. Chimney Effect With and Without Wind

The "chimney effect" (also called the "stack effect") refers to the rise of the hot buoyant gas exhaust through the chimney of a house or building—a phenomenon relied upon for proper operation of any chimney based on natural convection instead of forced (mechanical) convection. By using fluid mechanics as given in References 3, it can be proved that in the absence of wind, the flow of the exhaust gas through a chimney exists as long as the density (temperature) of the air entering the chimney is larger (smaller) than the density (temperature) of the exhaust gas leaving the chimney. However, in the presence of wind, the wind causes a negative pressure inside the building, counteracting the chimney effect in a manner analyzed and discussed in detail by Liu [4]. When the wind is sufficiently high, it generates a high negative building internal pressure, which in turn overpowers the normal chimney effect. In such a case, the exhaust gas from the burner, including carbon monoxide and smoke, cannot rise through the chimney. Rather, it flows back into the room in which the burner is located, causing a dangerous condition to the building occupants. Generally, the stronger the wind is, the greater this reverse chimney flow becomes and the greater the danger becomes. Therefore, proper control of the building internal pressure during windy days is the key to the prevention of the dangerous reverse chimney flow, and is the salient feature of this invention.

C. Stagnation Tube

To counteract the negative internal pressure generated by wind, which is the prime culprit for causing smoke and carbon monoxide to be sucked into the room during windy days, a stagnation tube is utilized in this invention to increase the building internal pressure. The concept of stagnation tube is explained in most fluid mechanics books and hence need not be explained here. Suffice to mention that it is based on the Bernoulli equation and the fact that when a tube with an open end is pointed into a flow of fluid (gas or liquid), the velocity of the fluid at the nose of the tube (i.e., the stagnation point) is always zero, and the pressure of the fluid there rises above the ambient pressure by an amount equal to 0.5 times (multiplies) the density of the fluid and times (multiplies) the square of the free-stream velocity. By attaching a vane to a pivoted stagnation tube, in a manner similar to attaching vanes to anemometers or some windmills, the stagnation tube opening will always be facing the wind. By connecting the other end of the stagnation tube to a pipe or tubing which in turn is connected to a room in which the building occupant is staying, the internal pressure of this room and other rooms is raised. This counteracts the detrimental effect caused by low internal pressure, and prevents the release of smoke and carbon monoxide into the building.

D. Integration and Utilization of the Three Principles to Yield the Subject Invention The subject invention represents an integration and utilization of the three principles stated above. For effective use of these principles, the opening of the stagnation tube must be always pointed into the wind (i.e., facing the wind). This requires the use of a properly designed and properly constructed stagnation tube that can rotate in a horizontal plane, having a vane attached to the stagnation tube. Furthermore, the size of the stagnation tube and the size of the conduit (tubing or pipe) used to connect the stagnation tube to the room should be sufficiently large—say, at least of 0.25-inch inner diameter. Otherwise, the system will be ineffective because it will not significantly increase the building internal pressure.

3. Alternative Invention

An alternate embodiment of this invention is to use a small air pump (i.e., a fan or a blower) to draw fresh outdoor air into the house to increase the internal pressure whenever there is a build-up of carbon monoxide or smoke indoor caused by reverse chimney flow. In the event of any reverse chimney flow, it is much better to pump fresh air into the house, such as into one or more than one bedroom in which the occupants are sleeping, in order to build-up the internal air pressure and to restore the normal upward chimney flow through the burner, than to pump the indoor air out, which would cause a further reduction in the internal pressure, drawing more burner exhaust into the house.

The air pump of the alternate embodiment is to be driven by an electric motor, which in turn is controlled by a carbon monoxide or smoke sensor or detector. Whenever the sensor or detector measures a dangerous level of carbon monoxide or smoke indoor, the detector not only sends off an alarm but also triggers the motor, which turns on the air pump. The air pump sends the outdoor fresh air into the building and raises the building internal pressure. The increased internal pressure stops the release of chimney exhaust into the building, and sends the exhaust off the building through the chimney as it should be. This counteracts the dangerous reverse chimney flow generated by wind. In the event that the high level of carbon monoxide or smoke is generated by a blocked or dogged chimney, the fan bringing fresh air into the building is still very helpful because it causes venting of the building, which drives out the carbon monoxide and replaces it with fresh air. This shows that whatever may be the cause of the indoor buildup of carbon monoxide, having the air pump bring fresh air into the building and raise the building internal pressure is always effective in solving the problem. It is more effective than having the pump operate in reverse direction (i.e., expelling indoor air) as it is normally done in venting buildings, which decreases building internal pressure and draws more exhaust into the building through the chimney. This shows the merit of this invention.

4. Salient Features of the Invention

Salient features of the subject invention include the following:

The invention removes a major cause of smoke and carbon monoxide generated indoor—the reverse chimney flow generated by wind. This is in contrast to conventional carbon monoxide safety devices, which either trigger an alarm when the carbon monoxide concentration is higher than a threshold value, or triggers a ventilation system such as opening a window or turn on a fan to expel the room air containing high concentration of carbon monoxide to outside. As explained before, expelling the indoor air by a fan can be counterproductive because it further decreases the internal pressure of the room, drawing more smoke and carbon monoxide from the burner into the room. The subject invention removes this shortcoming.

Although the invention is intended mainly for preventing indoor release of carbon monoxide and smoke resulting from indoor burners, it is also effective to a lesser degree for reducing the danger caused by building fires. In the even of any building fire, the invented device (both embodiments) causes the building internal pressure to rise, which in turn causes a portion of the smoke in the building to enter and exit through chimneys. This reduces the amount of smoke spreading inside the building. Also, since the increased internal pressure directs the internal airflow towards chimneys which act as fire and smoke sinks, spreading of the fire indoor will be retarded by using the invented device. In spite of this benefit, one should never rely on this invention as the principal means for protection against building fires. Other conventional means, such as having fire sprinklers and smoke alarms, are more effective. Therefore, this invention should be used only as a secondary means for reducing the danger against building fires. Its principal purpose is for reducing the danger of carbon monoxide and smoke generated by indoor burners.

The invented stagnation tube system is entirely mechanical. It is wind powered, and it requires no battery or electrical power to operate. This is in contrast to all other conventional systems or devices to protect building occupants from the danger of carbon monoxide and smoke build-up, which requires either batteries or electricity supplied to the building. In the event of a drained battery, or an electrical outage happened to a home, all the conventional devices will fail, whereas the invented stagnation tube system will still be functional and will continue to offer protection when all the other devices will not.

Because wind generated reverse chimney flow is not the only cause for the generation of carbon monoxide and smoke indoors (for instance, a severely blocked chimney can cause the same to happen), this invented device should not be used as the sole mechanism to protect the safety of building dwellers from the danger of carbon monoxide exposure. It should be used in combination with other devices, such as a carbon monoxide alarm system, which is triggered whenever the level of carbon monoxide is high, whatever the cause of generation of the carbon monoxide may be. What this device does is it offers additional protection in the event other systems failed due to low battery or power outage, or other reasons.

Greatest protection against carbon monoxide and smoke can be achieved by using several systems simultaneously: (a) a carbon monoxide warning system and a smoke alarm powered by batteries, (b) the system invented here based on forcing air into the building using an air pump powered by the same ac electricity supplied to the building for lighting, and (c) the alternate embodiment invented here based on the stagnation tube, which does not require the use of electricity.

The invented stagnation tube system does not work without wind. However, when wind is not blowing, there is no negative internal pressure in a building, and no danger of the reverse chimney flow that forces the burner exhaust into the house. Thus, the device is not needed without wind. This shows that the invented method (device) works whenever there is indoor emission of burner exhaust gas caused by wind.

As with all other systems and devices, proper maintenance is needed to insure that the device invented here is functional all the time when an indoor burner is used. For instance, inspection of the stagnation probe mounted on the roof should be done at least once a year to make sure that the probe is not damaged by wind or other sources. More frequently, one should check the conduit (tubing) connecting the stagnation tube to the room, to make sure that it is not clogged. This can be done rather easily by one of several means, such as by connecting an inflated balloon to the outlet of the conduit. If the balloon is not deflated within a few seconds, the conduit must be clogged. Unclogging the conduit can be done easily by connecting a small compressor, such as those used in households for inflating bicycle tires or car tires, to the conduit outlet. The compressed air will purge the conduit clean of any dust or insects build-up.

5. Description of and Comparison with Prior Art

Existing devices and methods for reducing the danger of having carbon monoxide in buildings are generally based on the detection (measurement) of the existence of carbon dioxide in a building, and then either to trigger an alarm (e.g., Reference 5), or to activate a venting mechanism, such as opening a window or starting a exhaust fan (e.g., Reference 6). Some more complex systems do both, i.e., triggering an alarm and activating a venting mechanism (e.g., Reference 7); they offer greater protection. However, all these systems depend on the use of electricity—either batteries or the alternating electrical current (60 hertz in the United States) supplied to buildings. Those that rely on batteries would not operate when the batteries are drained, and those that rely on the ac power would not work when the electricity is cut off, such as during a blackout. In contrast, the system invented here based on stagnation tube is wind powered; it needs no electricity to function. Through a literature search and patent search, the inventor has not found any existing device or method based on this mechanism.

The alternative embodiment of this invention, which is to pump outdoor air into the bedrooms of the house whenever there is a build-up of carbon monoxide in the house, is also unique. No prior art or invention based on the same concept has been found through a literature search and a patent search. The alternative embodiment is different from ordinary carbon monoxide venting systems which use fans to pump air out of the building, rather than into the building, which is less effective because they cause a reduction in the building internal pressure and a worsening of the revers chimney flow.

BRIEF SUMMARY OF THE INVENTION

The object of the invention is a new means to prevent indoor release of carbon monoxide and smoke from any indoor burner (stove, fireplace, furnace, etc.), in order to protect the building occupants from being poisoned by these dangerous exhaust gases. The invention is based on the concept of increasing the building internal pressure in order to enhance the upward movement of combustion exhaust through chimneys, and to prevent any reverse chimney flow which releases smoke and carbon monoxide into buildings. The invention contains two embodiments. The first is to use an air pump (i.e., a fan or a blower) to pump outdoor fresh air into a building whenever a dangerous level of carbon monoxide or smoke is detected indoor. The air pump must be triggered by a carbon monoxide or smoke detector or sensor. This is different from existing means to venting buildings when a high level of carbon monoxide or smoke is detected. The existing means either pumps the indoor air out of the building (rather than the outdoor air into the building), or opens a window or vent when carbon monoxide or smoke is detected. The former (i.e., the existing means) often causes a drop of the building internal pressure, which may cause a reverse chimney flow, and draws more carbon monoxide and smoke into the building from the burner. The first embodiment of this invention, on the other hand, causes the building internal pressure to rise, Thus, the first embodiment is more effective than conventional means to vent buildings by pumping indoor air out or by opening a window or vent when carbon monoxide or smoke is detected. The second embodiment uses a stagnation tube automatically oriented into the wind (i.e., facing the wind) in order to generate the stagnation pressure, which in turn forces the outdoor air into the building. As in the case of the first embodiment, use of the second embodiment results in the increase in the building internal pressure, which prevents the release of any smoke and/or carbon monoxide into the building from an indoor burner. Thus, the second embodiment has more or less the same advantage of the first embodiment over existing means. The second embodiment has the further advantage over existing means in that it is powered by wind and hence does not rely on electrical power supply or batteries. It protects the building occupants even when the power supply is failed and/or batteries are drained. These two alternative embodiments can be used either separately or jointly. When used jointly, they provide greater protection than a single system can, regardless of the cause of the carbon monoxide buildup in a building. Either of the embodiments can and should also be supplemented with a conventional carbon monoxide alarm system and/or a smoke alarm system to offer further protection to the building occupants. The greatest protection can be achieved by using both embodiments plus a carbon monoxide alarm and a smoke alarm operated by battery. In doing so, whether or not there is a blackout (power outage), or whether or not it is windy, there will always be plenty of protection for the building occupants against carbon monoxide and smoke.

DETAILED DESCRIPTION OF THE INVENTION

The two embodiments of the current invention (both the air pump system and th stagnation tube system) are a method and device (system) to increase the building internal pressure during windy time and/or when the indoor concentration of carbon monoxide is high for whatever reasons. Both systems work by increasing the internal pressure of the building in which a burner is used, so that the exhaust of the indoor burner containing carbon monoxide and smoke will be vented out through the chimney rather than being released into the building, thereby preventing the accumulation of carbon monoxide indoor. The only difference between the two embodiments is the way that internal pressure increase is achieved. While the air pump system relies on the actuation of an air pump to draw fresh air into the building and to enhance the building internal pressure, the other embodiment uses a stagnation tube that orients itself into the wind (facing the wind) in order to accomplish the same. The operation of the two alternate systems (embodiments) will now be described one by one in detail with reference to the nine figures provided.

1. The Air Pump System (Embodiment 1)

Figure 1:
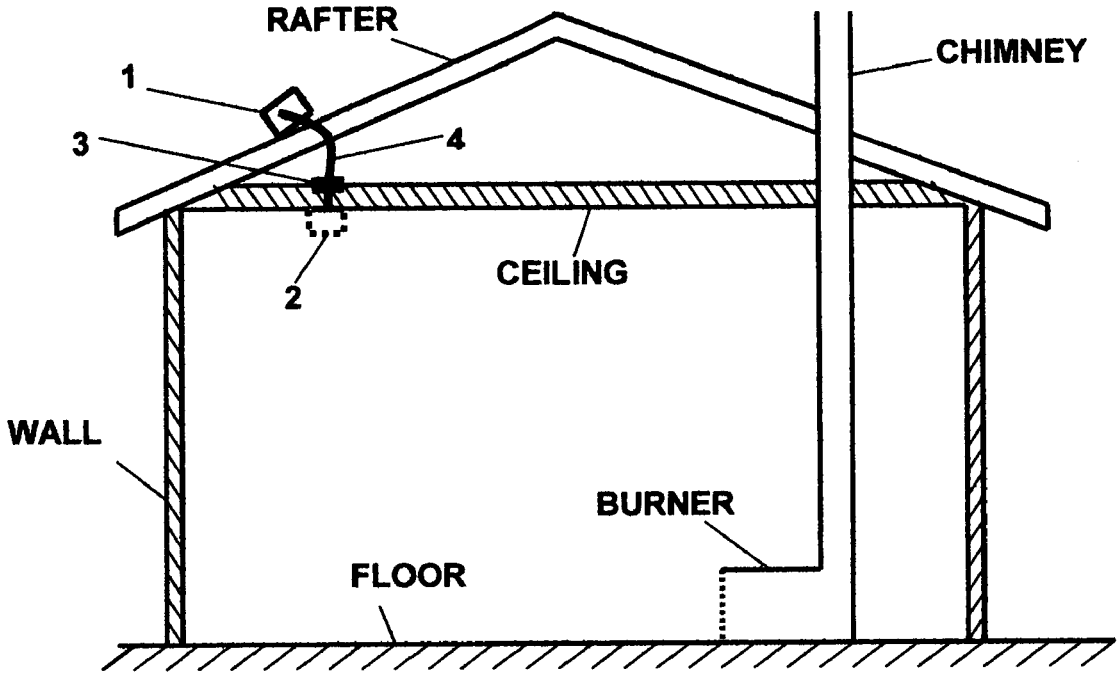
FIG. 1 is a side elevation view of a typical house having a burner in the house and having the invented air pump device (embodiment 1) mounted on the building. The invented device consists of four general parts: the air intake, 1, mounted on the roof; the air outlet, 2, mounted indoor beneath the ceiling; the air pump, 3, above the ceiling; and the connecting tubing, 4.
Figure 2:
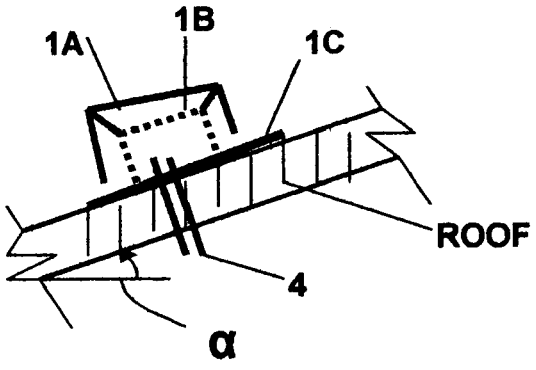
FIG. 2 is an enlarged elevation view of the air intake, 1, mounted on the roof. 1A is the inlet cover, which shields the inlet from dust, rain and snow; 1B is a fine screen that further prevents debris and insects from entering the inlet; 1C is the mounting plate for attaching the outlet to the roof; and a is the roof angle. As before, 4 is the connecting tubing.
Figure 3:
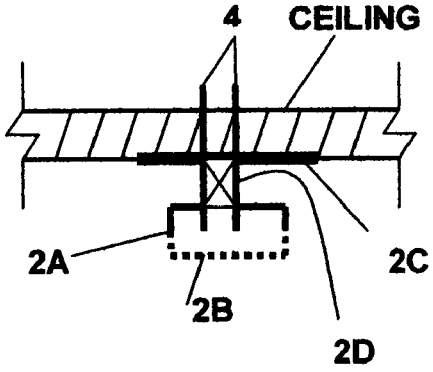
FIG. 3 is an enlarged elevation view of the air outlet, 2, in FIG. 1. Items 2A, 2B, 2C and 2D are respectively the outlet cover, the fine screen, the mounting plate, and the control valve. An alternative embodiment of this system is to mount the air inlet on the exterior wall of the house, not shown here.

The air pump system, hereafter also referred to simply as "the system," or "embodiment 1," is illustrated by FIGS. 1, 2 and 3. FIG. 1 is an overall view of the system mounted in a house or building in which there is a burner (any kind of stove, furnace, fireplace, or boiler) that burns a fuel and that may generate carbon monoxide when the combustion is incomplete to convert all the carbon in the fuel to carbon dioxide. Illustrated in FIG. 1 includes a roof-mounted air intake, 1, a ceiling-mounted air outlet, 2, a ceiling mounted air pump, 3, and a conduit or connecting tubing, 4. For simplicity in drawing, the building is shown here with one room only. In reality, the building can have and usually has a number of interconnected rooms. Usually, while the system outlet, 2, is placed in a bedroom, the burner with the chimney or flue is in a separate room. Better yet, an outlet, 2, is placed in each bedroom. This will make the bedrooms to have the highest internal pressure, causing air to flow from the bedrooms through connecting rooms and corridors to the burner room and then entering the burner, thereby aiding the normal upward chimney flow and minimizing the chance of carbon monoxide and smoke generated by the burner to enter bedrooms.

The conduit, 4, can be mad of a number of materials, such as steel, copper, or plastic. It can be either rigid or flexible. When using rigid conduits, bends or elbows will be needed at locations of the change of direction. When using flexible conduits or tubing, one should make sure that the tubing will not kink or collapse to restrict the air flow. The conduit must be sized according to the length required and the needed air flow rate, using standard calculation methods in fluid mechanics, or in piping handbooks. It can also be standardized for buildings of various sizes. When multiple conduits are used to connect a single air inlet to various rooms, the conduits can be connected through a manifold. The air pump, 3, can either be a fan or blower, depending on the air flow rate and the pressure required. Usually, a fan is for low pressure but high flow rate, whereas a blower generates higher pressure but lower flow rate than a fan. Use of a compressor will be inappropriate because the compressor is for high pressure and low flow rate, a situation unlike that encountered by air flow through buildings. An engineer or technician with knowledge in sizing venting systems and selecting the size and the type of air pumps is required to determine the appropriate components of any given system. They will depend on the building size, the permeability of the building, and the length and size of the conduit or connecting tubing.

FIG. 2 is an enlarged elevated side view of the air intake mounted on the roof. It should be mounted at a location of the roof away from the chimney outlet, in order to prevent the chimney effluent from entering the air intake. An alternative mounting position of the air intake is a wall away from the chimney outlet, preferably near the top of the wall under the eave to minimize the entrainment of rain. As shown in FIG. 2, the air intake subsystem includes a bottom-vented cover (1A) that prevents rain from entering the intake, a fine screen (1B) that prevents insects and debris from entering the intake, and a mounting plate (1C) for mounting the intake structure on the roof by bolts and nuts, or screws. Note that the mounting plate angle $\alpha$ should be approximately the same as the roof angle. Otherwise, the mounted intake will be tilted. For flat roof, the angle $\alpha$ is zero degree. From FIG. 2, not that the conduit (connecting tubing), 4, penetrates the roof structure and the mounting plate, so that air can enter the conduit through the air intake. The connection between the conduit and the air intake can be done by using any standard connection or coupling, such as a screwed-in connection or a push-on connection, or by using a specially designed connector.

FIG. 3 shows a ceiling-mounted air outlet, 2. It consists of the following parts: a cover (2A), a screen (2B), a mounting plate (2C), and a control valve (2D). The control valve is needed to adjust the flow rate entering the building, and to shut it off completely when the system is not in use, such as in summer when the burner (a stove for heating the building) is not in use. An optional feature is an on-off valve, such as a ball valve or a plug valve that can be used easily to shut off the air flow completely when it is not needed, and to open it completely when the system is in operation. Note that while FIG. 3 is for a ceiling mounted air outlet, with only minor modifications the outlet can also be mounted on the wall or the floor inside buildings, depending on the need and personal preferences.

A typical operation of the foregoing system (embodiment 1) is described as follows. As soon as a conventional carbon monoxide alarm mounted in a building has been set off by the presence of a high concentration of carbon monoxide over a significant period, such as 100 parts per million over a period of ten minutes, depending on the type of alarm used, the device sends out an electric, electromagnetic, or acoustic signal to a detector (receiver) of such signal connected to the air pump. In lieu of a carbon monoxide alarm, a smoke alarm may also be used in the same manner. The detector turns on a switch which starts the air pump. Because the control valve, item 2D in FIG. 3, is always left open when the burner is in use, air will be drawn into the building and the internal pressure will rise as soon as the air pump is on. The aforementioned process is relatively simple. What is innovative (novel) about this process or method is that air is pumped into the building rather than out of the building when the indoor concentration of carbon monoxide or smoke is high, which is contrary to what ordinary carbon monoxide or smoke venting systems do. The invented new system is more effective than ordinary venting systems for smoke and carbon monoxide in that it increases rather than decreases the building internal pressure, thereby sending the smoke and carbon monoxide out of the building through the chimney rather than drawing them into the building. So, the invention is not merely a venting system; it is a means to control (raise) building internal pressure, which in turn drives carbon monoxide and smoke out through the chimney.

This invention follows an accidental discovery and a great deal of subsequent scientific analysis conducted by the applicant, as described in Brief History of the Invention. The invention had not been obvious even to the applicant, who is an expert in fluid mechanics and wind engineering, until recently through the discovery and the scientific analysis presented in Reference 4 and in this invention. As with other engineering devices, successful use of this invented means and system requires proper maintenance of the system. Not only should the system shown in FIG. 1 be property maintained and frequently checked, the carbon monoxide or smoke detector that turns on the air pump must also be checked frequently to insure that it is functioning properly. The manufacturer's recommendation on maintaining such auxiliary equipment must be followed to insure that the equipment is in good working order all the time. The conduit of the system, part 4 in FIG. 1, should also be checked frequently to make sure that it is not clogged. Clogging can be checked easily by feeling the air flow entering the room through the outlet, 2, when the air pump is turned on.

2. The Stagnation Tube System (Embodiment 2)

Figure 4:
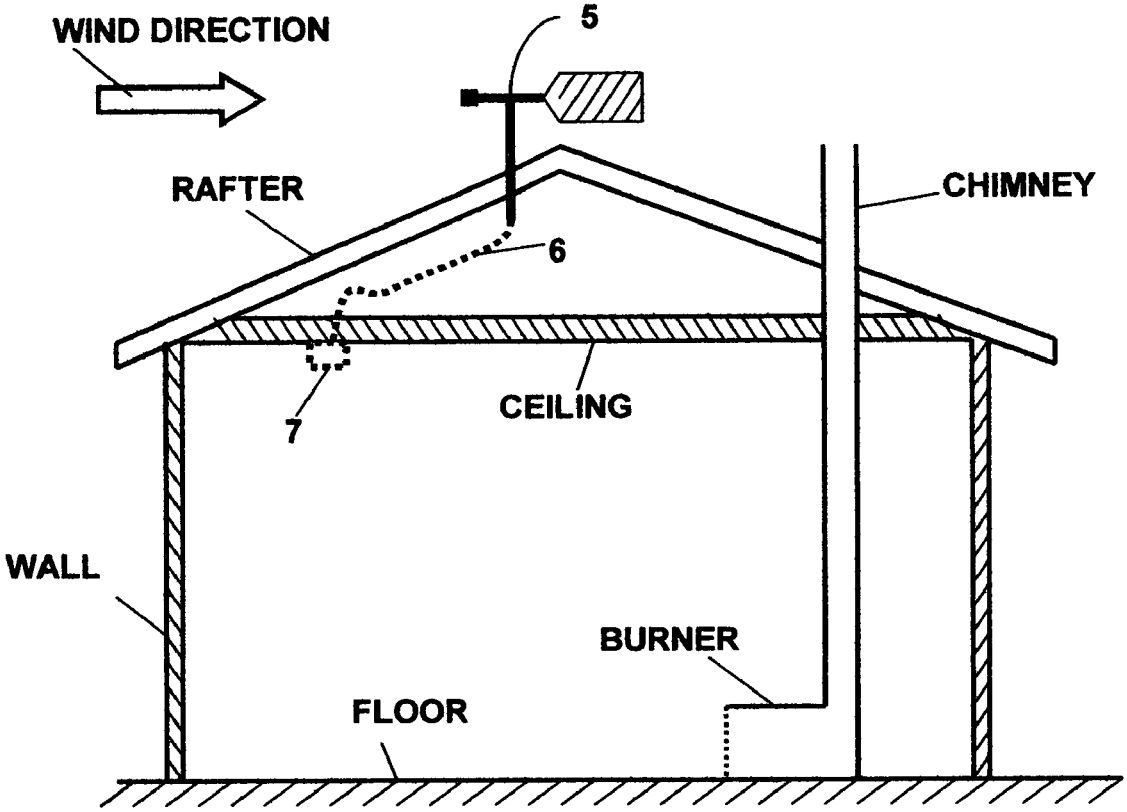
FIG. 4 is a side elevation view of the stagnation tube system, used here to increase the building internal pressure. In this system, 5 is the stagnation tube, 6 is the connecting tubing, and 7 is the outlet mounted beneath the ceiling in an appropriate room such as a bedroom.

Referring first to FIG. 4, the system invented here (embodiment 2) contains three general parts or components, marked as 5, 6 and 7. These three parts are respectively as follows: 5 is a special stagnation tube that is always facing the wind so that a raise of air pressure from the ambient air pressure, equal to the stagnation pressure generated by wind, is created inside the tube; 6 is the conduit or tubing that connects the outlet (bottom) of the stagnation tube (part 5) to the system outlet fixture (part 7); and 7 is the outlet fixture inside the building, preferably placed in one or more than one bedroom, for reasons as explained in Embodiment 1. Note that part 6 transmits the stagnation pressure generated by part 5 to part 7, which in turn feeds the pressurized outside air into the room in which the outlet is mounted, in order to increase the building internal pressure. Together the three parts work as a single system to reduce the chance of indoor release of carbon monoxide and smoke that might otherwise happen when wind is blowing, for reasons explained before.

Figure 5:
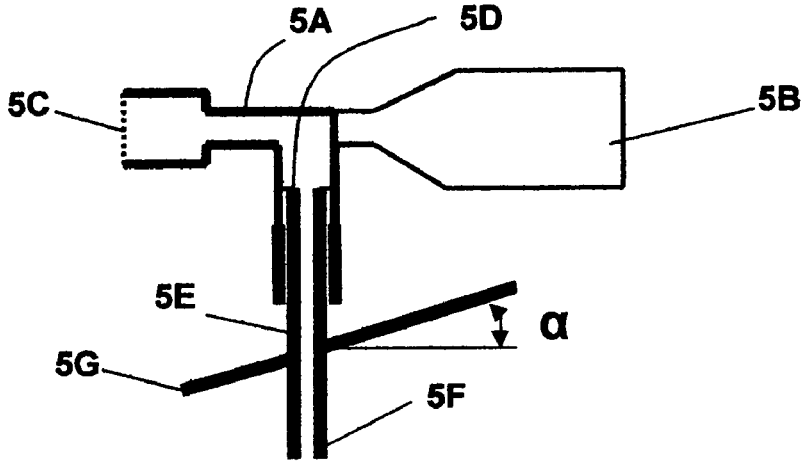
FIG. 5 is an enlarged side elevation view of the stagnation tube subsystem, part 5, used for controlling building internal pressure. Items 5A, 5B, 5C, 5D, 5E, 5F and 5G are respectively the main body of the rotating part of the tube, the guide vane, the inlet screen, the stopper, the standpipe, and the mounting plate. The angle $\alpha$ is the slope angle of the mounting plate, which is the same as the roof angle.

FIG. 5 illustrates the details of part 5, the stagnation tube subsystem. Part 5A is a stagnation tube free to rotate in a horizontal plane, and is always facing the wind. The entrance of the tube is enlarged to facilitate the development of the stagnation pressure in the entrance region, and to prevent (impede) rain water from entering the rest of the tube. A guide vane, part 5B, is rigidly attached to the stagnation tube in order to cause the latter to face the wind and generate the stagnation pressure. Part 5C is a fine screen at the opening of the stagnation tube, which is needed to prevent insects and wind-borne debris to enter the tube. Preferably, the screen should be made of stainless steel or a strong plastic material such as nylon so that it can last a long time. Furthermore, it is preferable to use a removable screen, such as a screen that can be threaded to the head of the stagnation tube, so that it can easily be replaced as needed. Part 5D is a ring shaped stopper (washer) welded to the inside of the vertical part of the tube 5A. It prevents the upper part of the subsystem, 5A, 5B and 5C, from sinking around the standpipe, part 1E, which would otherwise block the air flow through the tube. Note that 5A, 5B, 5C and 5D are all fixed together. They are free to rotate horizontally as a single piece as the wind direction changes. They are the rotating part of the stagnation tube subsystem. They rotate freely around the fixed vertical tube, 5E, which is hereafter referred to as the "standpipe." The bottom of the standpipe, 5F, is to be connected to part 6, the tubing, for transmitting pressure to part 7 and the room, as shown in FIG. 4. Note that the standpipe must penetrate the roof—see FIG. 4. It is a fixed tube or pipe that is attached to the exterior of the roof through a mounting plate, 5G, as shown in FIG. 5. The mounting plate angle, $\alpha$, is the same as the roof angle. Thus, a equals zero for flat roofs and so forth. The system described here can be used for buildings of any roof angle and geometry.

Figure 6:
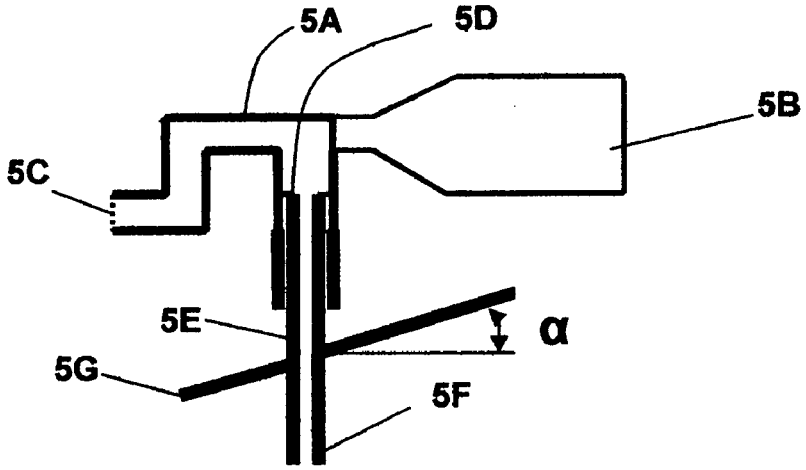
FIG. 6 is an alternative embodiment of the stagnation tube subsystem. The only difference between this subsystem and the one given in FIG. 5 is the entrance part of the tube, 5A. While this entrance part in FIG. 5 is a simple enlarged inlet, the corresponding part in FIG. 6 (the alternative embodiment) is an inverted L shape—an L shape if the tube in the drawing were pointed toward the right.

FIG. 6 is an alternate design of the stagnation tube subsystem shown in FIG. 5. The only difference between the two designs is in the front part of the stagnation probe. While the front part in FIG. 5 is a straight horizontal tube with an enlarged body and opening at the front, for the subsystem in FIG. 6 the front part of the stagnation probe is L-shaped. The vertical part of the L prevents rain water from rising and entering the rest of the tube. Therefore, it is a better design than the straight horizontal system in FIG. 5 from the standpoint of drainage of rain. In spite of that, both designs are expected to work. Many other designs of the tube front and vane shapes are also possible for this invention, such as by using the enlarged inlet of FIG. 5 combined with the L shape of FIG. 6. Together they provide maximum protection against rain. In all th cases, the purpose is the same: having a tube opening always facing the wind, and preventing rain from entering the tube except near the opening where the trapped rain can drain readily. To facilitate drainage, one or more small holes may be provided on the bottom part of the tube inlet in any design. Whatever the design may be, the stagnation tube must be relatively large, at least 6 mm inner diameter, in order to be effective. The front opening (entrance) should be at least 10 mm in diameter. The size of the tube and opening should increase with increasing building size, and with increasing negative internal pressure caused by wind. It can be calculated by using the equation for pressure drop along a pipe (the Darcy-Weisbach formula) given in ordinary fluid mechanics texts such as Reference 3. For ordinary homes, a size of 0.5 inch (12.7 mm) for the tube, and 1.5 inches (38 mm) for the entrance, may be appropriate.

Figure 7:
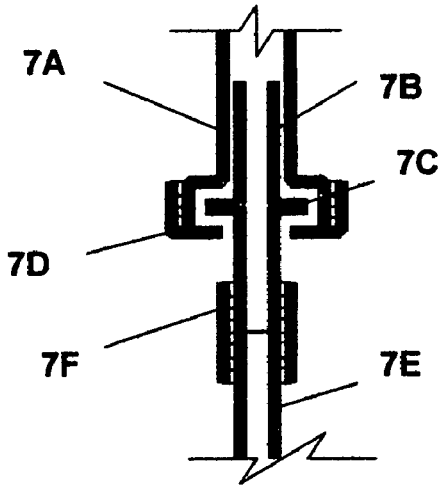
FIG. 7 is a side elevation view of an alternative design of the standpipe (part 5E in FIG. 5) and what is around it, to make the stagnation tube system resistant to wind uplift. Items 7A, 7B, 7C, 7D, 7E and 7F are respectively the lower part (vertical part) of the rotational stagnation tube, the upper standpipe (the equivalent of item 5E in FIGS. 5 and 6) which is stationary, the disc (wheel) welded or cast around the upper standpipe, the threaded pipe cap with a central hole that can be attached (threaded) to the lower end of item 7A, the lower standpipe, and the threaded pipe coupling that attaches the lower standpipe (7E) to the upper standpipe (7B).

Not shown in FIGS. 5 and 6 is a restraining mechanism (restrainer) which loosely connects the lower part of 5A to the standpipe, 5E, in order to prevent the rotary part of the stagnation tube from being lifted off the standpipe by high winds. A number of designs of the restraining mechanism are possible. An example is shown in FIG. 7, which is discussed as follows:

FIG. 7 illustrates a design of the stationary standpipe (7B and 7E) and the portion of the rotating pipe around it (7A)—the vertical part of the rotating stagnation tube, in order to accomplish the straining mechanism. Note that the lower end of this rotating pipe (7A) contains a sudden enlargement to accommodate a disc (wheel), 7C, which is fixed around the stationary standpipe. A threaded pipe cap with a hole in the center, 7D, is attached (threaded) to the enlargement of 7A; together they form a housing (pan) to enclose the disc 7C. With such an arrangement, the rotating pipe 7A will be free to rotate horizontally but will be prevented by the disc from vertical movements, except for a minute distance within the pan. To facilitate on-site installation of the system, the standpipe is made of two parts—the upper part 7B and the lower part 7E—which are joined together in the field during installation by a pipe coupling, 7F. Assembly of the parts during installation requires the following steps: (1) attach the lower standpipe to the roof by using the mounting plate 5G shown in FIGS. 5 and 6, (2) insert the upper standpipe with the disc (wheel) into the lower part of th rotating pipe 7A, (3) from the bottom end of the upper standpipe 7B, insert the pipe cap with center hole, 7D, around the upper standpipe, (4) attach (thread) the cap to the enlarged part of the rotating pipe 7A, and (5) connect the upper standpipe to the lower standpipe by using the coupling 7F. This completes the field installation. The foregoing process practiced in reverse order will enable the disassembly of the system for repair and maintenance. To reduce the wear between the rotating and the stationary parts, one may place a Teflon washer beneath the disc in FIG. 7, which is easy to do during assembly. The foregoing description shows the design of a restrainer for preventing the rotating stagnation tube from being lifted out the standpipe by high winds or a small animal. It is intended to be illustrative rather than restrictive.

The stagnation tube system also may work without any restrainer, especially if the rotating probe is made of steel or another heavy material. In such a case, the weight of the rotating probe may be sufficient to resist the uplift generated by high winds. Thus, whether to include a restrainer or not is a matter of consideration for each individual system design, depending on the probe materials used and the size of the probe. Generally, larger and heavier systems may not need the restraining mechanism, and vise versa.

Figure 8:
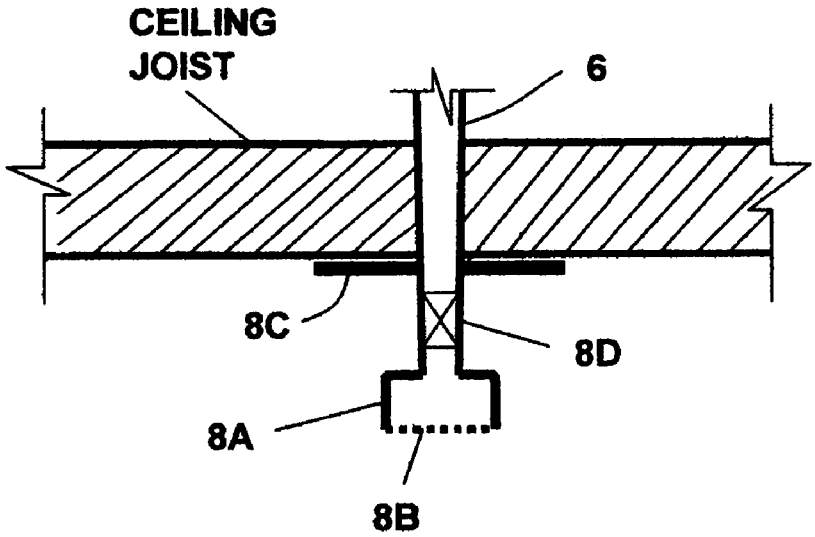
FIG. 8 is an enlarged elevation view of the stagnation tube system outlet, the same outlet 7 shown in FIG. 4. The outlet in FIG. 8 is mounted on (beneath) the ceiling. The parts or items 8A, 8B, 8C and 8D are respectively the outlet diffuser, the screen, the mounting plate, and the control valve. Part 6 is, as in FIG. 4, the connecting tubing.
Figure 9:
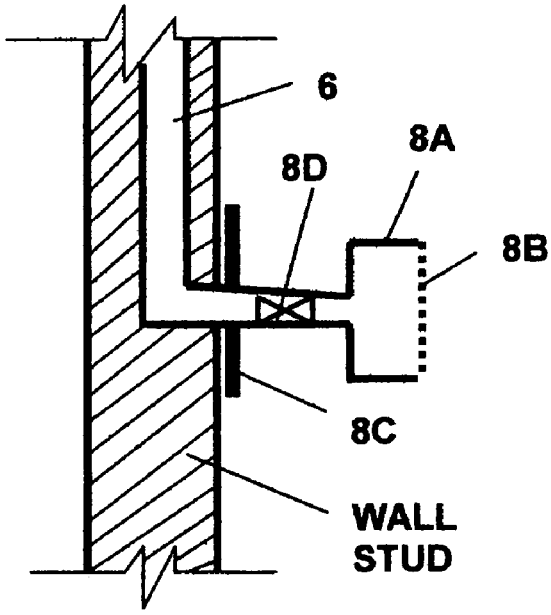
FIG. 9 is an alternative of the subsystem shown in FIG. 8, with the tube outlet mounted on the interior wall (vertical mounting) instead of the ceiling (horizontal mounting). Parts 8A through 8D are the same as those shown in FIG. 8 except for their mounting position (wall instead of ceiling) and orientation (vertical mount instead of horizontal mount).

The connecting tubing, part 6 shown in FIG. 4, can be either rigid (e.g., copper or PVC) or flexible (e.g., kink-resistant garden hose). In either case, the tubing should be able to bend easily without kink or collapse, and with minimum ovality. In places where sharp bends are needed, rigid bend fittings, such as a standard elbow, should be used. The end of the connecting tubing should penetrate either the ceiling or a wall, preferably of a bedroom. The end is attached to an outlet fixture which in turn is attached to either the ceiling (FIG. 8) or the wall (FIG. 9). Note that wall-mounted outlet fixtures such as shown in FIG. 9 require longer connecting tubing and more labor to install than ceiling-mounted outlet fixtures (FIG. 8). However, they may be less visible (easy to hide) than ceiling-mounted units, and easier to maintain because they are more reachable. Outlet fixtures can be mounted at any practical place of the ceiling or wall.

In FIG. 8, part 8A is the outlet cover, whose open end is connected to a fine screen, part 8B, in order to prevent insects from entering the outlet. Preferably, the screen should be a removable piece to facilitate maintenance. The other (upper) end of the outlet fixture is welded to a base plate, 8C, which in turn is held tightly around the lower end of the connecting tubing 6, as by using a threaded connection. For structural rigidity, the lower end of the connecting tubing 6 should be attached to a ceiling joist. For a wood joist, this can be done easily by using a metal strap and two screws, or by some other means. Part 8D is a control valve, such as a globe valve, that can be used both for throttling the flow and for on-off purpose. Alternatively, one may use both a valve such as a globe valve for flow control, and a valve such as a plug valve for on-off operations. In the case of wall mounting, FIG. 9, the lower part of the connecting tubing should be attached to a stud. All the rest are similar to ceiling mounting, and hence need no separate discussion. The outlet can be positioned at any practical location on the ceiling or wall, or even on the floor.

To operate the stagnation tube system (i.e., embodiment 2), all what one needs to do is to make sure that the valve(s) is (are) open whenever the burner is on. On a highly windy day, one may want to adjust the control valve somewhat so the air flow (draft) entering the room is not excessive. This can be done manually. To control the valves automatically will require sophisticated electronics, such as transducers and a PLC (programmable logic controller), and will require the use of a motor-driven control valve, and a solenoid driven on-off valve. Doing so will not only increase the cost significantly, it will also make the system to rely on electric power, which would render the system inoperative when there is an interruption of the electric power such as caused by a power failure. For these reasons, manual operation of valve(s) is recommended here, which is rather easy to do for this system that requires only infrequent closure and opening of valves. For the maintenance of a stagnation tube system, one should conduct periodic visual checks of the parts above the roof to make sure that they are not damaged by wind, rain, hail or birds. One must also make sure that the tubing is not dogged. This can be done by connecting an inflated balloon to the outlet, and to see if the balloon deflates quickly. If so, the line is not clogged. Clogged lines can be cleared by hooking the outlet to a small compressor such as that used in household for pumping bicycle tires and car tires. The compressor will clear the lines rapidly.

The above detailed description illustrates the invented method—how it can be designed, constructed, installed, used and maintained, and how it achieves the stated purpose of increasing the building internal pressure when wind is blowing outside, so that smoke and dangerous exhaust gases including carbon monoxide can be expelled through the chimney. There can be many alternative designs of the various parts as described herein without departing from the scope of this invention. Therefore, the above detailed description and the nine drawings shall be interpreted as being illustrative and not limiting.

This invention contains the following claims:

1. A system for reducing the release of exhaust gases selected from carbon monoxide, smoke and mixtures thereof from an indoor combustion device into the interior of a building housing the combustion device, the system comprising:

an air intake mounted on a roof or exterior wall of the building;

an air pump in fluid communication with the air intake to draw outdoor air into the building through the air intake when the air pump is activated;

a connecting conduit in fluid communication with the air pump to convey air from the air intake to an indoor outlet in the building and increase the building internal pressure when the air pump is activated;

a carbon monoxide or smoke detector located within the building that generates a signal in response to the concentration of carbon monoxide or smoke in the building exceeding a threshold value; and a receiver for receiving the signal generated by the detector, the receiver turning on a switch to activate the air pump when the signal is received from the detector.

2. A system as set forth in claim 1 further comprising a control valve for adjusting the flow rate of outdoor air entering the building.

3. A system as set forth in claim 1 further comprising an on-off valve for shutting off the flow of outdoor air into the building.

4. A system as set forth in claim 1 further comprising both a control valve for adjusting the flow rate of outdoor air entering the building and an on-off valve for shutting off the flow of outdoor air into the building.

5. A system as set forth in claim 1 wherein the system further comprises a chimney in fluid communication with the indoor combustion device for exhausting exhaust gases from the indoor combustion device out of the building housing the combustion device.

6. A system as set forth in claim 1 further comprising a shield associated with the air intake to prevent rain from entering the air intake.

7. A system as set forth in claim 1 further comprising a screen in the air intake to prevent debris from entering the system.

8. A system as set forth in claim 1 further comprising a manifold in fluid communication with a plurality of connecting conduits and with the air pump to convey air from the air intake to plurality of indoor outlets placed in separate rooms of the building.

9. A system as set forth in claim 1 wherein the indoor combustion device is selected from a stove, a furnace a fireplace or a boiler.

* * * * *